US011898106B2

(12) United States Patent
Vittur et al.

(10) Patent No.: US 11,898,106 B2
(45) Date of Patent: Feb. 13, 2024

(54) OIL-WETTING CHEMICALS FOR SOLIDS RETENTION

(71) Applicant: Baker Hughes Oilfield Operations LLC, Houston, TX (US)

(72) Inventors: Brandon Vittur, Sugar Land, TX (US); Carl E. Weaver, Conroe, TX (US); Tran M. Nguyen, Houston, TX (US); Lirio Quintero, Houston, TX (US); Leonardo Franca, Katy, TX (US); Jerry J. Weers, Richmond, TX (US); Joseph Arensdorf, Conroe, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/825,974

(22) Filed: May 26, 2022

(65) Prior Publication Data

US 2023/0383196 A1 Nov. 30, 2023

(51) Int. Cl.

| | |
|---|---|
| ***C10G 33/04*** | (2006.01) |
| ***C10G 29/20*** | (2006.01) |
| ***C10G 33/08*** | (2006.01) |
| ***C10G 29/28*** | (2006.01) |
| ***C10G 33/02*** | (2006.01) |

(52) U.S. Cl.

CPC ..... *C10G 33/04* (2013.01); *C10G 29/20* (2013.01); *C10G 29/28* (2013.01); *C10G 33/02* (2013.01); *C10G 33/08* (2013.01); *C10G 2300/1033* (2013.01); *C10G 2300/206* (2013.01)

(58) Field of Classification Search

CPC ... C10G 29/20; C10G 33/00–04; C10G 33/08

See application file for complete search history.

(56) References Cited

U.S. PATENT DOCUMENTS 6,120,678 A * 9/2000 Stephenson ..... B01D 17/06 507/224

FOREIGN PATENT DOCUMENTS

| | | | | |
|---|---|---|---|---|
| CN | 109097094 A | * | 12/2018 | ..... C10G 33/04 |
| WO | WO 96/05272 | * | 2/1996 | ..... C10G 33/04 |

OTHER PUBLICATIONS

English machine translation of CN 109097094 (Year: 2018).*

* cited by examiner

*Primary Examiner* — Renee Robinson

(74) *Attorney, Agent, or Firm* — Crowe & Dunlevy, P.C.

(57) ABSTRACT

It has been discovered that solid contaminants in a mixture of a hydrocarbon phase and an aqueous phase may be retained in the hydrocarbon phase by introducing to the mixture an effective amount of an oil-wetting additive to retain at least a portion of the solid contaminants in the hydrocarbon phase as contrasted with an aqueous phase. The oil-wetting additive can be a surface-active additive including, but is not necessarily limited to, drilling fluid additives, surfactants, antifoulants, nanoparticles and combinations thereof.

16 Claims, 6 Drawing Sheets

150 PPM D4 + 300 ppm additive
150 PPM D5 + 300 ppm additive
No demulsifier + 300 ppm additive

OIL-WETTING CHEMICALS FOR SOLIDS RETENTION

TECHNICAL FIELD

The present invention relates to methods and compositions for retaining solids in mixtures of a hydrocarbon phase and an aqueous phase, and more particularly relates, in one non-limiting embodiment, to methods and compositions for retaining solids in the hydrocarbon phase of mixtures of a hydrocarbon phase and an aqueous phase.

BACKGROUND

In industrial processes, there is often a need to transfer species from one place to another either to remove that species from the process as a contaminant, or to recover that species as a desirable product. In more complex processes, transferring different species can be done more than once in an effort to purify a particular product (e.g., removing one or more types of contaminants) or recovering a valuable product for later use or sale, for example in the recovery of metals from ore. The phase of the species, for instance, gas, liquid, or solid, will affect the processes used to move it from one place or another. For example, in the processing of liquids, solids can be considered contaminants and can thus be removed; for instance, by filtration.

In the non-limiting example of oil exploration and recovery, in an oil refinery, the desalting of crude oil has been practiced for many years. The crude is usually contaminated from several sources, including, but not necessarily limited to:

- Brine contamination in the crude oil as a result of the brine associated with the oil in the ground;
- Minerals, clay, silt, and sand from the formation around the oil well bore;
- Metals including calcium, zinc, silicon, nickel, sodium, potassium, etc.;
- Nitrogen-containing compounds such as amines used to scrub $H_2S$ from refinery gas streams in amine units, or from amines used as neutralizers in crude unit overhead systems, and also from $H_2S$ scavengers used in the oilfield; and
- Iron sulfides and iron oxides resulting from pipeline and vessel corrosion during production, transport, and storage.

Desalting is necessary prior to further processing to remove these salts and other inorganic materials that would otherwise cause fouling and deposits in downstream heat exchanger equipment and/or form corrosive salts detrimental to crude oil processing equipment. Further, these metals can act as poisons for the catalysts used in downstream refinery units and can cause furnace coking. Thus, the contaminants may include, but not necessarily be limited to, metals; salts; solids other than salts including, but not limited to sand and clays; amines; and combinations thereof. The metals may include, but not necessarily be limited to, those in Periodic Table Groups IA, IIA, IVA, IB, IIB, VB, VIB, and VIII. More particularly the metals include, but are not necessarily limited to, calcium, magnesium, iron, zinc, nickel, chromium, lead, cadmium, copper, and combinations thereof.

Effective crude oil desalting can help minimize the effects of these contaminants on the crude unit and downstream operations. Proper desalter operations provide the following benefits to the refiner:

- Reduced crude unit corrosion.
- Reduced crude preheat system fouling.
- Reduced potential for distillation column damage.
- Reduced energy costs.
- Reduced downstream process and product contamination.

Desalting is the resolution of the natural emulsion of water that accompanies the crude oil by creating another emulsion in which about 5 percent relative wash water is dispersed into the oil using a mix valve. The emulsion mix is directed into a desalter vessel containing a parallel series of electrically charged plates. Under this arrangement, the oil and water emulsion is exposed to the applied electrical field. An induced dipole is formed on each water droplet within the emulsion that causes electrostatic attraction and coalescence of the water droplets into larger and larger droplets. Eventually, the emulsion resolves into two separate phases—the oil phase (top layer) and the water phase (bottom layer). The streams of desalted crude oil and effluent water are separately discharged from the desalter.

Normally, chemical additives are injected before the mix valve to help resolve the oil/water emulsion in addition to the use of electrostatic coalescence. These additives effectively allow small water droplets to more easily coalesce by lowering the oil/water interfacial tension.

Crude oil that contains a high percent of particulate solids can complicate the desalting process. The particulate solids, by nature, would prefer to transfer to the water phase. However, much of the solids in a crude oil from a field exists in tight water-in-oil emulsions. That is, oil-wetted solids in high concentration in the crude may help form tight oil and water emulsions that are difficult to resolve.

As mentioned, much of the solids encountered during crude oil desalting consists of iron, most commonly as particulate iron such as iron oxide, iron sulfide, etc. Other metals that are desirably removed include, but are not necessarily limited to, calcium, zinc, silicon, nickel, sodium, potassium, and the like, and typically a number of these metals are present. Some of the metals may be present in a soluble form. The metals may be present in inorganic or organic forms. In addition to complicating the desalter operation, iron and other metals are of particular concern to further downstream processing. This includes the coking operation since iron and other metals remaining in the processed hydrocarbon yields a lower grade of coke. Removing the metals from the crude oil early in the hydrocarbon processing stages is desired to eventually yield high quality coke as well as to limit corrosion and fouling processing problems.

Several treatment approaches have been made to reduce total metal levels and these all center on the removal of metals at the desalter unit. Normally, the desalter only removes water soluble inorganic salts such as sodium or potassium chlorides. Some crude oils contain water insoluble metal organic acid salts such as calcium naphthenante and iron naphthenate, which are soluble or dispersed as fine particulate matter in the oil but not in water. Typically, the solids removed from crude oil are disposed of in an environmentally responsible way, which can be expensive.

In an unusual situation, one oilfield operator, based on their internal studies, determined that the disposal cost for solids is greater than an increase in the cost associated with fouling in operations downstream of the desalter. Conventional current solids treatment products are all designed to water-wet solids and mobilize them into the desalter brine, as discussed above.

It would thus be desirable to develop compositions and methods employing them that would cause most or all of the solids in the crude oil to be retained in the oil phase in a desalter operation.

SUMMARY

There is provided, in one non-limiting form, a method of retaining solid contaminants in a hydrocarbon phase involving adding to a mixture of a hydrocarbon phase and an aqueous phase, where the mixture comprises solid contaminants, an additive composition including an effective amount of an oil-wetting additive to retain at least a portion of the solid contaminants in the hydrocarbon phase as contrasted with an aqueous phase, where the oil-wetting additive comprises a surface-active additive selected from the group consisting of drilling fluid additives, surfactants, antifoulants, and combinations thereof.

In another non-limiting embodiment, there is provided a treated mixture that includes a hydrocarbon phase, an aqueous phase, solid contaminants, and an additive composition including an effective amount of an oil-wetting additive to retain solid contaminants in the hydrocarbon phase as contrasted with an aqueous phase, where the oil-wetting additive is a surface-active additive selected from the group consisting of drilling fluid additives, surfactants, antifoulants, and combinations thereof.

DETAILED DESCRIPTION

Figure 1:
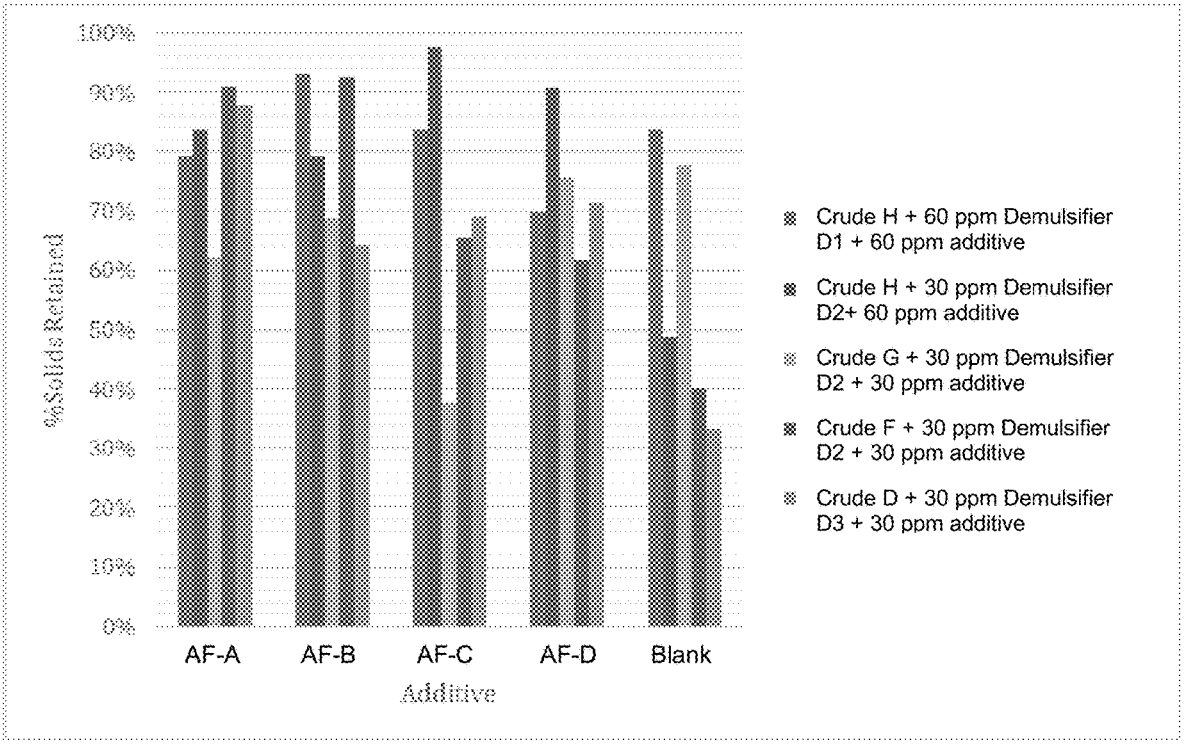
FIG. 1 is a graph of the wt % solids retained in a variety of crude oils having various oil-wetting additive compositions containing an antifoulant added thereto as compared with a blank.

It has been discovered that certain oil-wetting additives can effectively retain solids in an oil phase of a mixture of an oil phase and an aqueous phase during a desalting step, as one non-limiting embodiment. Research identified a class of oil-wetting additives able to retain up to 98 wt % of the solids in some cases. It is expected that these oil-wetting additives will also function to retain solids in the hydrocarbon phase in other applications, including, but not limited to, retaining asphaltenes in the hydrocarbon phase. These oil-wetting additives are also expected to be useful in retaining solid corrosive components in the hydrocarbon phase of a mixture of the hydrocarbon phase and an aqueous phase, where the solid corrosive component includes, but is not necessarily limited to, inorganic acids, organic acids, salts, and combinations thereof. In methods for treating mixtures containing one or more solid corrosive components, one or more corrosion inhibitors may also be present. Stated another way, the solids are moved from an aqueous phase to the hydrocarbon phase due to the effect of the oil-wetting additive.

This technology represents a fundamental shift in the traditional treatment strategy. Conventionally, it is a goal to water-wet the solids so that they are retained in the aqueous phase. However, unusually there can be cases where it is more economical overall to keep the solids in the hydrocarbon phase, and thus exploration was undertaken how to oil-wet various solids contained in oil slates that have different oil and water properties. Performance was determined by the amount of filterable solids remaining in the top oil after a standard desalting performance test.

The oil-wetting additives found to be useful include, but are not necessarily limited to, chemicals typically used as drilling fluid additives, surfactants, antifoulants, and combinations thereof. Suitable drilling fluid additives include, but are not necessarily limited to, alkyl sulfonate surfactants and blends of an alkyl sulfonate surfactant, propylene glycol, and an alcohol, and combinations of these.

Suitable surfactants include, but are not necessarily limited to, surfactants having a hydrophobic-lipophilic balance (HLB) between about 3 independently to about 6; alternatively, between about 1.8 independently to about 4.6; and in a different non-limiting embodiment between about 4.3 to about 4.7, and combinations of these. As used herein with respect to a range, the term "independently" means that any endpoint may be used together with any other endpoint to give an acceptable alternative range. Two particularly suitable surfactants include sorbitan monostearate (HLB=4.7) and sorbitan monooleate (HLB=4.3).

Suitable antifoulants include, but are not necessarily limited to, acrylic copolymers, polyalkylsuccinim ides, mixtures of the reaction product of an olefin with an anhydride and a peroxide and a polyolefin amide alkeneamine, a reaction product of a polyolefin phenol with an amine, a fatty acid, and formaldehyde, and combinations of these. One non-restrictive version of a suitable reaction product of an olefin with an anhydride and a peroxide are those made by reacting ammonia with a C24-C28 alpha olefin reacted with maleic anhydride and di-t-butyl peroxide. One non-limiting embodiment of suitable polyalkylsuccinim ides are those made by reacting ammonia with a C24-C28 alpha olefin reacted with maleic anhydride and di-t-butyl peroxide.

In another non-limiting embodiment, the oil-wetting additives may include nanoparticles comprising any of the functional groups borne by the oil-wetting additives described above. Suitable nanoparticles for this application include, but are not necessarily limited to, those with functional groups including, but not necessarily limited to, hydrophobic groups. Particular nanoparticles useful as oil-wetting additives include, but are not necessarily limited to, carbon nanotubes, functionalized carbon nanotubes, deformable polymer latex, nanoparticles such as but not limited to magnesium oxide, barium sulfate and polydimethylsiloxane and combinations thereof.

Nanoparticles believed to be useful in changing the wettability of downhole surfaces include, but are not necessarily limited to, magnesium oxide, block copolymers, functionalized nanoclays, silicates and aluminas. Nanoparticles suitable to affect the oil-wettability of solids may include, but are not necessarily limited to those having a size less than 999 nm, and may be silica, magnesium oxide, iron oxide, copper oxide, zinc oxide, alumina, boron, carbon black, graphene, carbon nanotubes, ferromagnetic nanoparticles, nanoplatelets, surface modified nanoparticles; which may be optionally functionalized with functional group including, but not necessarily limited to, sulfonate, sulfate, sulfosuccinate, thiosulfate, succinate, carboxylate, hydroxyl, glucoside, ethoxylate, propoxylate, phosphate, ethoxylate, ether, amines, amides and combinations thereof. One non-limiting, specific suitable nanoparticle is iodododecane-functionalized vinylpyrrolidone/vinylimidazole copolymer.

Nanoparticles that are bifunctional have been termed "Janus" particles because they may be of platelet shape where the functional groups on one side are hydrophobic and the functional groups on the other side are hydrophilic. This bifunctionality is expected to exist with other nanoparticles such as carbon single-walled nanotubes (SWNTs) or multi-walled nanotubes (MWNTs) where one end of the tube has primarily or exclusively hydrophobic functional groups and the other end of the tube has primarily or exclusively hydrophilic functional groups. Such bifunctional nanoparticles, as well as nanoparticles which carry a charge, are expected to be useful to change the wettability of surfaces downhole, such as filter cakes, drill cuttings, wellbore surfaces, deposits which cause stuck pipe (primarily filter cakes, but other deposits may also cause problems). Such wettability changes, for instance from water-wet to oil-wet would be useful as oil-wetting additives. Such bifunctional nanoparticles may be used alone or together with conventional surfactants, co-surfactants and/or co-solvents.

The effective amount of the oil-wetting additive ranges based on the mixture introduced into a mixture of a hydrocarbon phase and an aqueous phase ranges from about 5 ppm independently to about 500 ppm in one non-limiting embodiment; alternatively, from about 20 ppm independently to about 450 ppm; in another non-restrictive version from about 50 ppm independently to about 400 ppm; on the other hand, from about 100 ppm independently to about 350 ppm.

Some of the additive compositions containing the oil-wetting additives described above have been found to benefit by including an optional demulsifier. Beneficial optional demulsifiers include, but are not necessarily limited to, oxyalkylated alkyl phenolic resins. Two specific suitable examples include a blend of a nonylphenol resin oxyalkylate with a p-t-amylphenol resin oxyalkylated and blends of a nonylphenol resin oxyalkylate with a p-t-butylphenol resin oxyalkylate. Additional demulsifier chemistry includes, but is not restricted to, copolymers of ethylene oxide and propylene oxide (polyols), cross-linked polyols, and amine oxyalkylates. Different common aromatic solvents may be used in the blends. The amount of optional demulsifier may range from about 5 ppm independently to about 200 ppm based on the mixture of a hydrocarbon phase and an aqueous phase in one non-limiting embodiment; alternatively, from about 10 ppm independently to about 100 ppm.

The solid contaminants that are oil-wet in the methods described herein may generally be metals, salts, solids other than salts, and combinations thereof. The solid salts may be, but are not necessarily, metal salts. Solid metal salts that can be oil-wet by the methods herein include, but are not necessarily limited to, salts of metals of calcium, iron, zinc, silicon, nickel, sodium and potassium. The retention of particulate iron in the form of iron oxide, iron sulfide, etc. is a specific, non-limiting embodiment of the method. By "retaining" the solids in the hydrocarbon or crude is meant any and all partitioning, sequestering, separating, transferring, eliminating, dividing, removing, of one or more metal from the hydrocarbon or crude to any extent. Asphaltenes may also be the solids treated by the method herein. Additionally, solid corrosive components including, but not necessarily limited to, inorganic acids, organic acids, salts, and combinations thereof may be oil-wet in the methods described herein.

While a goal of the method described herein is to keep all (100%) of the solid contaminants in the hydrocarbon phase, in one non-limiting successful embodiment at least 95 wt % of the solid contaminants are retained in the hydrocarbon phase. Alternatively, at least 97 wt % of the solid contaminants are retained, and in a different non-restrictive version at least 99 wt % of the contaminants are retained in the hydrocarbon phase.

The invention will be illustrated further with reference to the following Examples, which are not intended to limit the invention, but instead illuminate it further. Throughout this specification, proportions are on a weight basis unless otherwise noted.

EXAMPLES

The Electrical Desalting Dehydration Apparatus (EDDA) is a laboratory instrument used to model a desalter. The EDDA is a batch process that applies an electrical field to oil-water emulsion samples in tubes that are inserted into a cell. The temperature and voltage are controlled to model the same conditions that the crude oil is under in a refinery. The EDDA allows for eight different crude oil samples to be treated in one test run with different chemicals for demulsification and contaminant removal. The EDDA in previous projects has been proven to effectively model a desalter even though a batch process is being to use to model a continuous process.

The standard operating procedure (SOP) for the EDDA was used in this study. Data for filterable solids, basic sediment and water (BS&W), and elements were obtained by a Petra Max laboratory analyzer after each experiment. The Petra Max laboratory instrument uses high-definition x-ray fluorescence (HDXRF) for detection of a spectrum of elements. The accuracy of the Petra Max is comparable to the inductively coupled plasma (ICP) mass spectrometry.

Several different crude oils were utilized in the screening of various chemicals during this research. The goal was to use a standard crude oil containing a high amount of solids (preferably 100 pounds per thousand barrels (ptb)). The crudes and blends noted in Table I were evaluated.

TABLE I

Evaluated Crude Oils and Blends

| Crude Oil Name | Location | Filterable Solids (ptb) |
|---|---|---|
| Crude A | El Paso, TX | 53 |
| Crude B | Corpus Christi, TX | 99 |

TABLE I-continued

| Evaluated Crude Oils and Blends | | |
|---|---|---|
| Crude Oil Name | Location | Filterable Solids (ptb) |
| Crude C | 50/50 vol. blend of Crudes A + B | 80 |
| Crude D | Midwest US | 42 |
| Crude E | El Paso, TX | 67 |
| Crude F | Detroit, MI | 55 |
| Crude G | Non-traditional crude | 45 |
| Crude H | Corpus Christi, TX | 43 |

Table II presents a detailed description of the oil-wetting additives typically used as antifoulants that were used in this research. As will be demonstrated, this information can be used to design new chemistries specific to oil-wetting rather than fouling prevention.

TABLE II

| Antifoulant Candidates for Oil-Wetting Additives | |
|---|---|
| Name | Additive Description |
| AF-A | Acrylic copolymer |
| AF-B | Polyalkylsuccinimide made by reacting ammonia with the reaction product of a C24-C28 alpha olefin reacted with maleic anhydride and di-t-butyl peroxide |
| AF-C | A mixture of a reaction product of a C24-C28 alpha olefin reacted with maleic anhydride and di-t-butyl peroxide and a polyolefin amide alkeneamine |
| AF-D | A reaction product of a polyolefin phenol, tetraethylene pentaamine (TEPA), oleic acid, and formaldehyde |

The demulsifiers used in the Examples herein are as follows:

| Demulsifier Name | Description |
|---|---|
| D1 | blend of a nonylphenol resin oxyalkylate with a p-t-amylphenol resin oxyalkylate with an aromatic solvent |
| D2 | blends of a nonylphenol resin oxyalkylate with a p-t-butylphenol resin oxyalkylated with an aromatic solvent |

-continued

| Demulsifier Name | Description |
|---|---|
| D3 | blends of a nonylphenol resin oxyalkylate with a p-t-butylphenol resin oxyalkylate with an aromatic solvent different from D2 |
| D4 | blend of a nonylphenol resin oxyalkylate and a p-t-amylphenol resin oxyalkylate with an aromatic solvent |
| D5 | blends of a nonylphenol resin oxyalkylate and a p-t-butylphenol resin oxyalkylated with an aromatic solvent, different from D4 |

FIG. 1 presents a graph of the wt % solids retained in Crudes H, G, F, and D using oil-wetting antifoulant additives AF-A, AF-B, AF-C, and AF-D as compared with a blank in the EDDA method. In every experiment except the nontraditional crude (Crude G), at least one of the antifoulant oil-wetting additives outperformed the blank. FIG. 1 thus shows the promise of this class of chemicals for solids retention.

Figure 2:
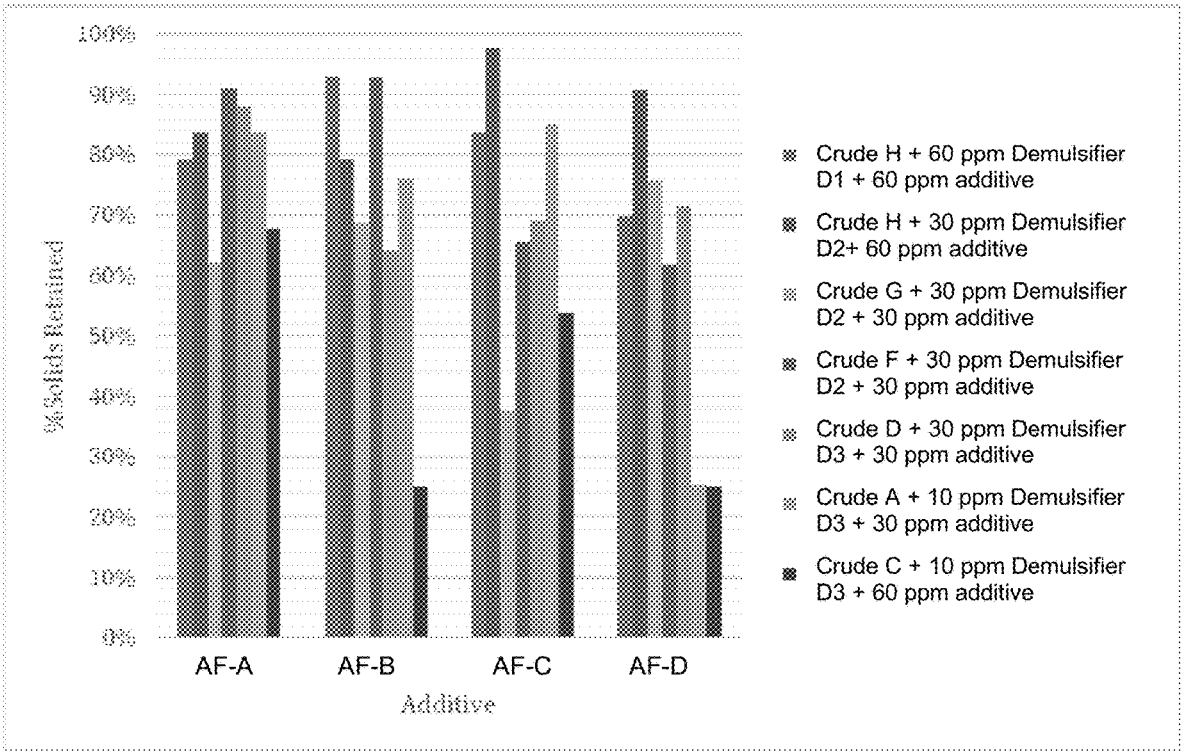
FIG. 2 is a graph of the wt % solids retained in a variety of crude oils having additive compositions containing various oil-wetting antifoulants added thereto as compared with each other.

FIG. 2 presents a bar chart of the wt % solids retained in Crudes H, G, F, D, A, and C using oil-wetting antifoulant additives AF-A, AF-B, AF-C, and AF-D in the EDDA method comparing them with each other. Each of the different oil-wetting antifoulant additives performed the best in at least one experiment. AF-A was the most consistent followed by AF-C. AF-D had the worst performance overall, but was the best in the non-standard crude—Crude G. As noted in FIG. 1, the blank performed the best in this non-standard crude. While there appears to be no statistical difference between AF-D and the Blank for wt % solids retained, it is expected that AF-D would perform well under different conditions; for example, when AF-D used in a different crude oil and/or in different concentrations. It is known that different additives perform differently in different crudes.

Table III presents the number of experiments where the antifoulant oil-wetting additive was the top performer in retaining each element in the oil phase or tied for best for that element. Of note is AF-D's ability to retain iron and nickel compared to the other antifoulant oil-wetting additives.

TABLE III

| Count of Experiments Where the Antifoulant was the Top Performer | | | | | | | | | | |
|---|---|---|---|---|---|---|---|---|---|---|
| | Element | | | | | | | | | |
| Additive | S | Cl | K | Ca | V | Cr | Fe | Ni | Cu | Zn |
| AF-A | 3 | 7 | 4 | 5 | 4 | 3 | 2 | 1 | 3 | 4 |
| AF-B | 6 | 1 | 1 | 3 | 2 | 4 | 1 | 3 | 2 | 2 |
| AF-C | 3 | 3 | 0 | 4 | 3 | 2 | 1 | 3 | 1 | 1 |
| AF-D | 1 | 1 | 4 | 4 | 5 | 2 | 6 | 7 | 4 | 3 |

Figure 3:
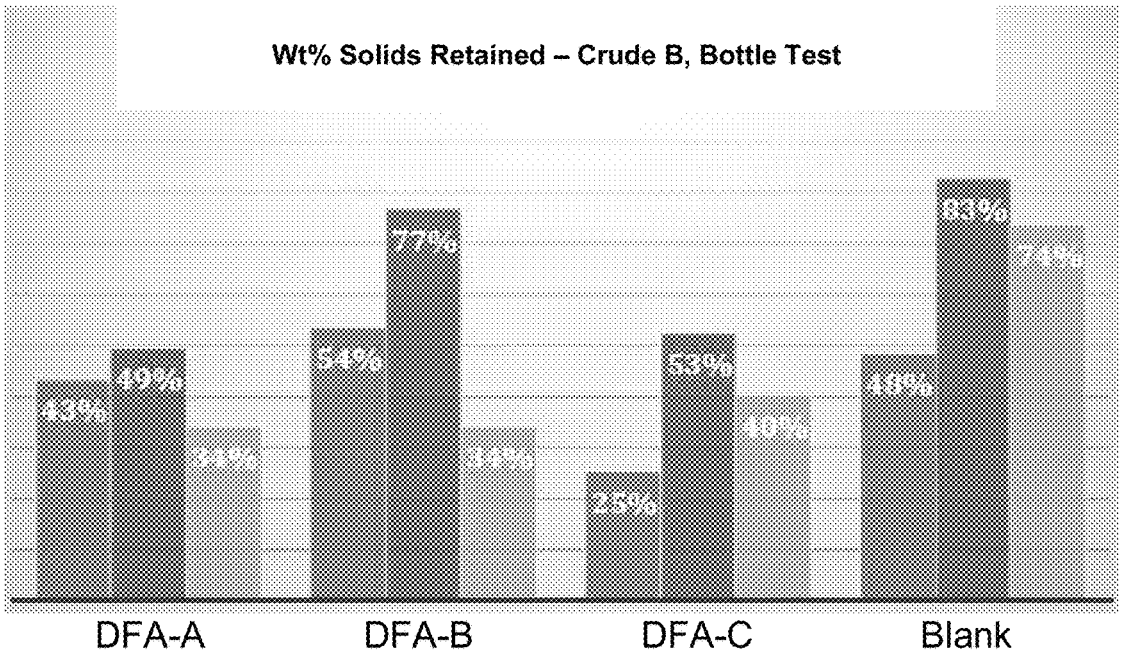
FIG. 3 is a graph of the wt % solids retained in Crude B having oil-wetting additive compositions containing various drilling fluid oil-wetting additives added thereto as compared with a blank.

FIG. 3 presents a bar chart showing solids retention by three drilling fluid additives with promise as oil-wetting additives as compared with a blank. These are defined below:

DFA-A blend of polyolefin amide alkeneamine surfactant and a fatty acid methyl ester surfactant DFA-B alkyl sulfonate surfactant DFA-C Blend of alkyl sulfonate surfactant with propylene glycol and a C8 alcohol In only one experiment did one of the drilling fluid additives, DFA-B, outperform the blank. However, it is expected that these oil-wetting additives may perform more successfully under different conditions.

Figure 4:
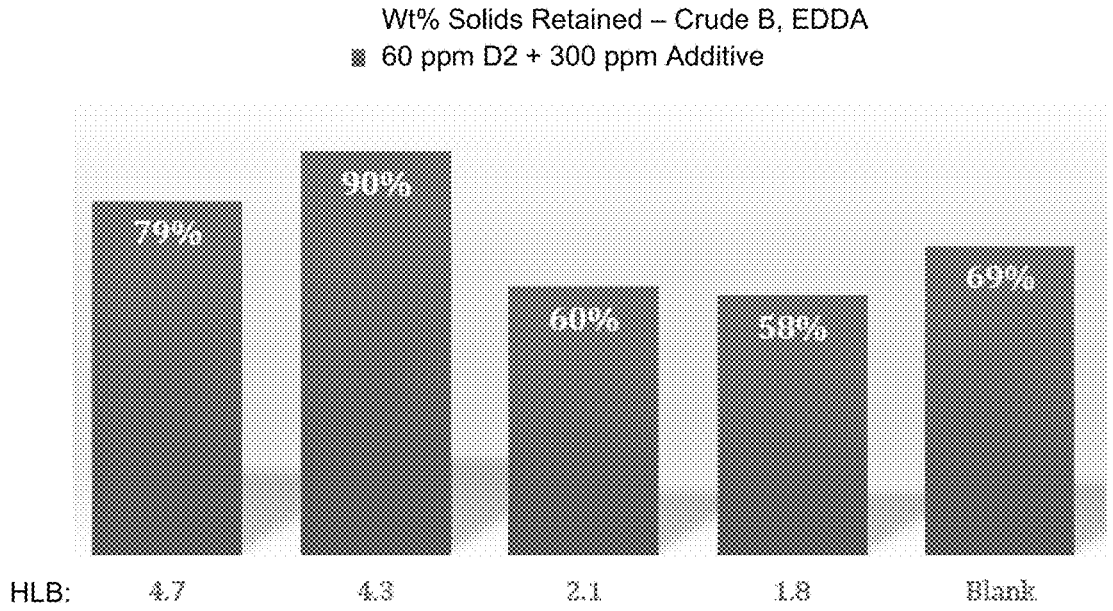
FIG. 4 is a graph of the wt % solids retained in Crude B having oil-wetting additive compositions containing various surfactants added thereto as compared with a blank.

FIG. 4 is a bar chart of the wt % solids retained in Crude B having additive compositions containing various surfactants added thereto as compared with a blank, where the surfactants are identified by HLB. It may be seen that the surfactant with HLBs of 4.7 and 4.3 performed better than the blank. Thus, the information that the optimum HLB may be between 4.3 and 4.7 will help optimize future products with improved oil-wetting properties. The particular chemical is identified in Table IV.

TABLE IV

Surfactant Oil-Wetting Additive Candidates

| Chemical | HLB |
|---|---|
| Sorbitan monostearate | 4.7 |
| Sorbitan monooleate | 4.3 |
| Sorbitan tristearate | 2.1 |
| Sorbitan trioleate | 1.8 |

Figure 5:
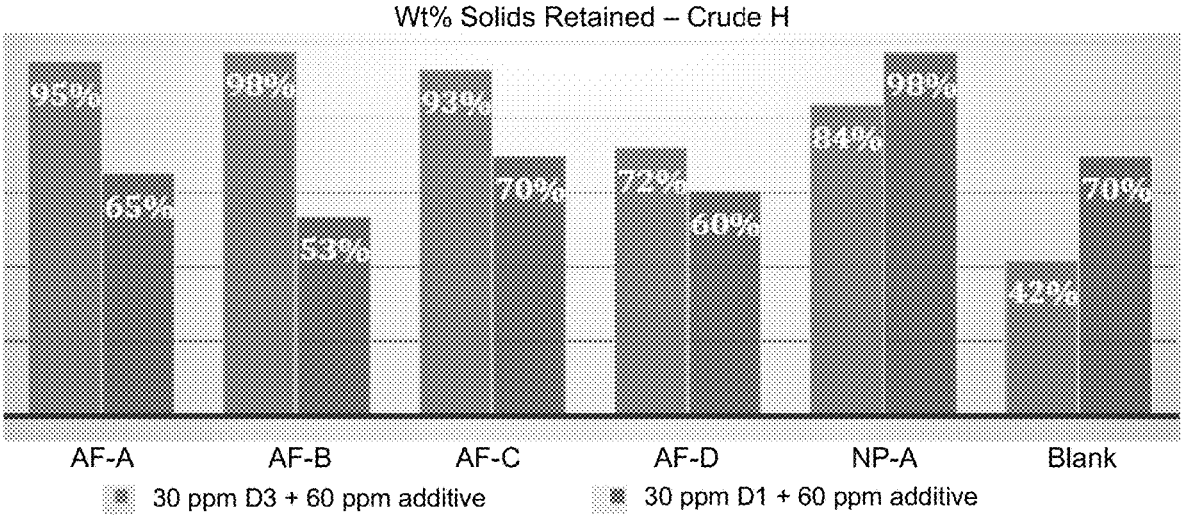
FIG. 5 is a graph of the wt % solids retained in Crude H having additive compositions containing various antifoulants and one nanoparticle added thereto as compared with a blank.

FIG. 5 presents a bar chart of the wt % solids retained in Crude H having additive compositions containing various antifoulants and one nanoparticle added thereto as compared with a blank using two different demulsifiers. In all instances, when D3 was used, more solids were retained as compared the blank, which was not the case with D1. Only nanoparticle NP-A outperformed the blank when D3 was used. NP-A is iodododecane-functionalized vinylpyrrolidone/vinylimidazole copolymer, and is not an antifoulant additive. For the combinations of the antifoulants of FIG. 5 where D3 was used, BS&W was 0.3, as shown in Table V. For the combinations of the antifoulants of FIG. 5 where D1 was used, BS&W was 0.2, with one exception.

TABLE V

BS&W Data for Demulsifier & Additive Combinations of FIG. 5

| Demulsifier | Additive | BS&W |
|---|---|---|
| D3 | AF-A | 0.3 |
| D3 | AF-B | 0.3 |
| D3 | AF-C | 0.3 |
| D3 | AF-D | 0.3 |
| D3 | NP-A | 0.3 |
| D3 | Blank | 0.3 |
| D1 | AF-A | 0.2 |
| D1 | AF-B | 0.2 |
| D1 | AF-C | 0.3 |
| D1 | AF-D | 0.2 |
| D1 | NP-A | 0.2 |
| D1 | Blank | 0.2 |

Figure 6:
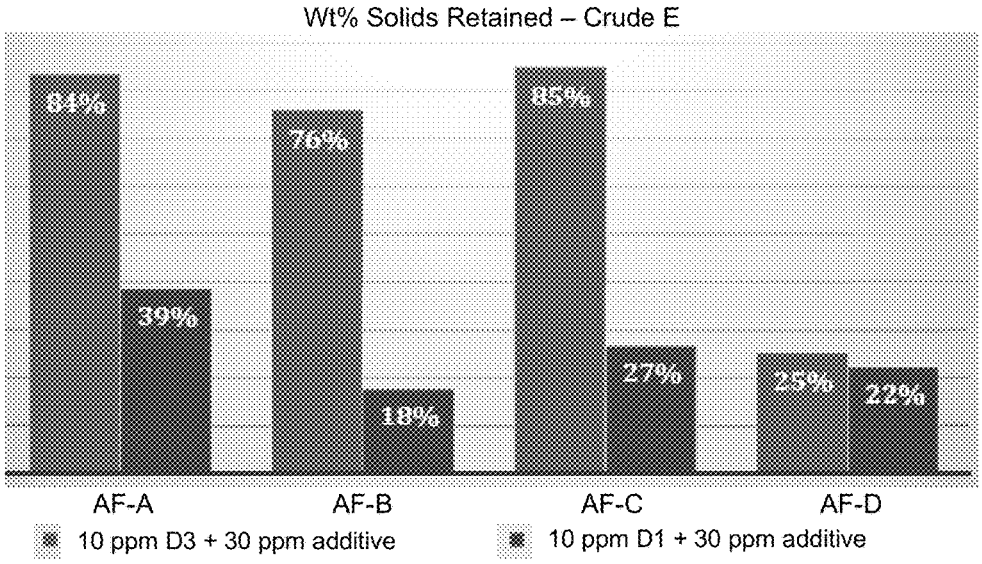
FIG. 6 is a graph of the wt % solids retained in Crude E having additive compositions containing various oil-wetting antifoulants added thereto as compared with a blank.

FIG. 6 presents a bar chart of the wt % solids retained in Crude E having additive compositions containing various antifoulants added thereto as compared with a blank using two different demulsifiers. In all instances, when D3 was used, more solids were retained as compared when D1 was used. For the combinations of the antifoulants of FIG. 5 where both D3 and D1 were used, BS&W was 0.

As evident from the results in FIGS. 5 and 6, the type of demulsifier chosen can have a significant impact on the % solids retained. In these results, D3 performed the best in most situations.

Figure 7:
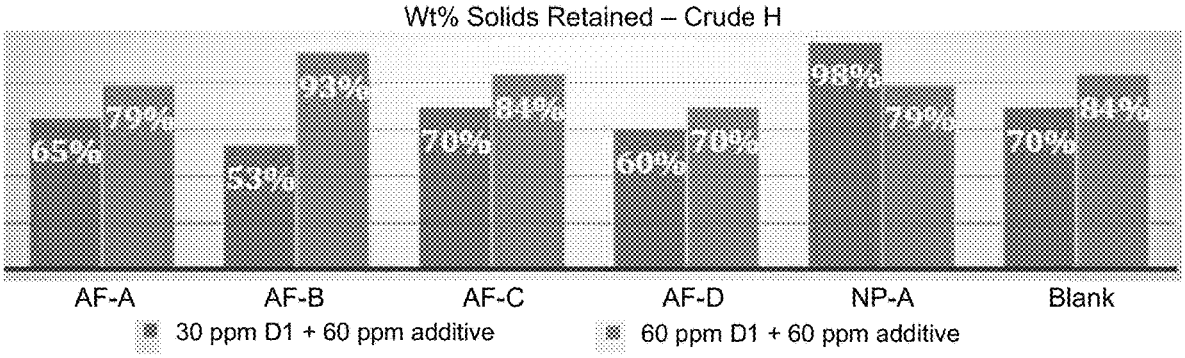
FIG. 7 is a graph of the wt % solids retained in Crude H having oil-wetting additive compositions containing various antifoulants and one nanoparticle added thereto using two different concentrations of a demulsifier as compared with a blank.

FIG. 7 presents a bar chart of the wt % solids retained in Crude H having additive compositions containing various antifoulant oil-wetting additives and one nanoparticle added thereto as compared with a blank comparing two different dosages of demulsifier D1. Table VI present BS& W data for the demulsifier D1 dosages of the FIG. 7 Examples. These data demonstrate that demulsifier dosage can have a positive impact on solids retention, but may have a negative impact on BS&W.

TABLE VI

BS&W Data for Demulsifier & Additive Combinations of FIG. 7

| Dosage (ppm) | Additive | BS&W |
|---|---|---|
| 30 | AF-A | 0.2 |
| 30 | AF-B | 0.2 |
| 30 | AF-C | 0.3 |
| 30 | AF-D | 0.2 |
| 30 | NP-A | 0.2 |
| 30 | Blank | 0.2 |
| 60 | AF-A | 0.4 |
| 60 | AF-B | 0.4 |
| 60 | AF-C | 0.4 |
| 60 | AF-D | 0.4 |
| 60 | NP-A | 0.4 |
| 60 | Blank | 0.4 |

Figure 8:
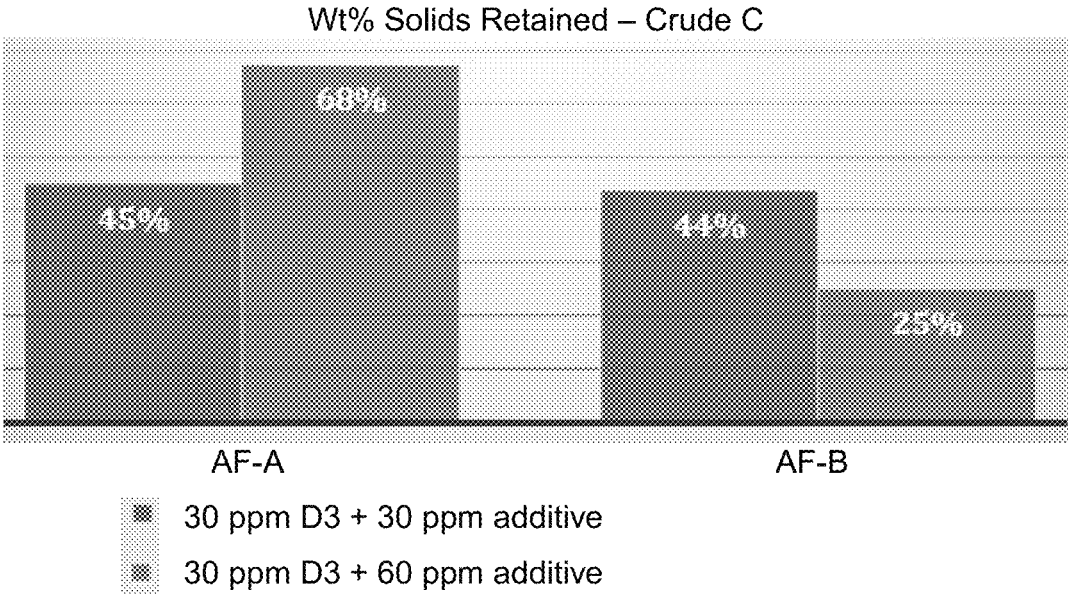
FIG. 8 is a graph of the wt % solids retained in Crude C having oil-wetting additive compositions containing various antifoulants added thereto as compared to each other.
Figure 9:
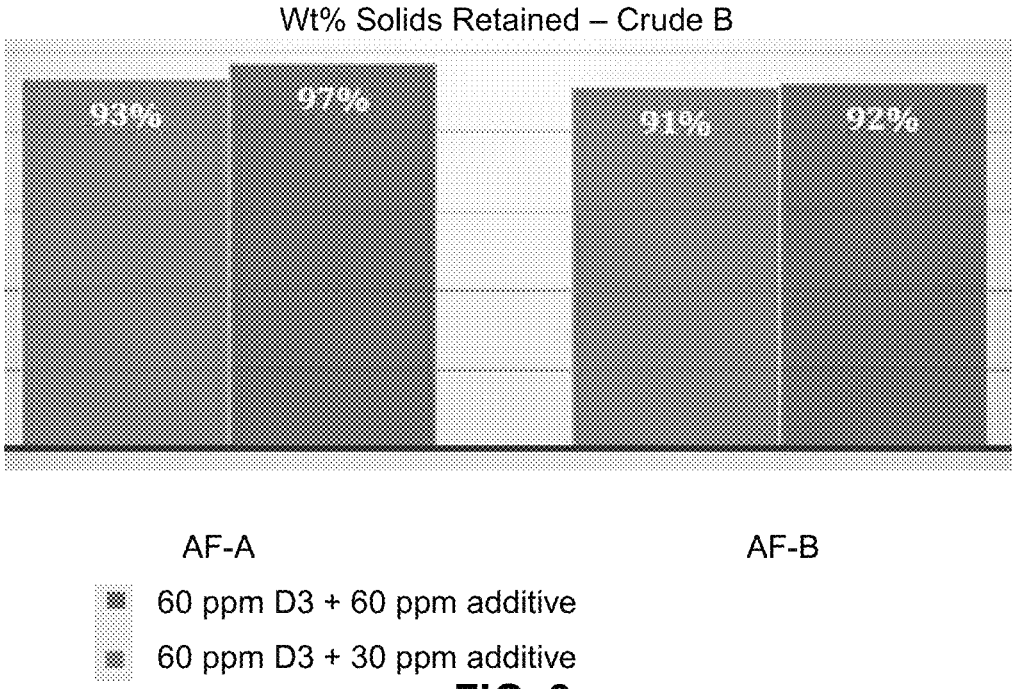
FIG. 9 is a graph of the wt % solids retained in Crude B having oil-wetting additive compositions containing various antifoulants added thereto as compared to each other.

FIGS. 8 and 9 present bar graphs showing the effect of additive dosage on wt % solids retained. As noted, the additives are AF-A and AF-B. In FIG. 8, 30 ppm of D3 was used. In FIG. 9, 60 ppm of D3 was used. Tables VII and VIII present the BS&W results. From these data, it may be seen that increasing the additive dosage may not provide much improvement, and could even reduce performance and increase BS&W in some situations.

TABLE VII

Effect of Additive Dosage at 30 ppm D3 on BS&W

| Additive | Dosage (ppm) | BS&W |
|---|---|---|
| AF-A | 60 | 0.4 |
| AF-B | 12 | 0.4 |
| AF-A | 30 | 0.2 |
| AF-B | 6 | 0.2 |

TABLE VIII

Effect of Additive Dosage at 60 ppm D3 on BS&W

| Additive | Dosage (ppm) | BS&W |
|---|---|---|
| AF-A | 60 | 2 |
| AF-B | 12 | 2 |
| AF-A | 300 | 1.6 |
| AF-B | 300 | 1.8 |
| Blank | | 2 |

This research identified a class of chemicals for future research and development of commercial products. The data generated from the tests undertaken provide information for the retention of solids that will be useful for future projects regarding solids mobilization. However, additional work is needed to identify the best demulsifier for these applications and to understand the dose response of the various additives.

The results from this research show that a specific group of antifoulants are able to oil-wet a large percentage of solids and keep them mobilized in the oil-phase. One commonality in these additives is that they are alpha olefin maleic anhydride reaction products. The non-alpha olefin maleic antifoulant did not perform as well at retaining total solids, however it tended to retain more Fe and V, possibly in association with asphaltenes. This information will be useful as products are developed specifically for this application.

Additives used as wetting agents for oil-based muds did not perform well as a group compared to the blank.

Experiments conducted with several sorbitan chemistries of varying HLB values showed the optimum HLB value for oil-wetting is between 4.7 and 4.3 for the conditions tested. As chemistries are developed for this application, the HLB values of the products can be fine-tuned to optimize performance.

Included in the scope of the project was a promising nanoparticle which performed better in some experiments than the antifoulant chemistries. This chemistry is not commercially available at the moment and would require developing a new and different manufacturing process.

Several experiments were performed to look for trends in the data. The following additional trends were observed:

- The dosage of the additive did not appear to have a consistent impact on the results;
- Increasing the dosage of the demulsifier did improve the performance of the additives, but also negatively impacted the BS&W; and
- The type of demulsifier had a significant impact on the ability of the additives to keep the solids in the oil-phase.

In the foregoing specification, the invention has been described with reference to specific embodiments thereof, and has been demonstrated as effective in retaining solid contaminants in the hydrocarbon phase of a mixture of a hydrocarbon phase and an aqueous phase, as non-limiting examples. However, it will be evident that various modifications and changes can be made thereto without departing from the broader scope of the invention as set forth in the appended claims. Accordingly, the specification is to be regarded in an illustrative rather than a restrictive sense. For example, specific mixtures of hydrocarbon phases and aqueous phases, oil-wetting additives, drilling fluid additives, surfactants, antifoulants, nanoparticles, dispersants, dosages, and solids other than those specifically exemplified or mentioned, or in different proportions, falling within the claimed parameters, but not specifically identified or tried in a particular application to transfer metals and/or amines into the aqueous phase, are within the scope of the method and compositions described herein. Similarly, it is expected that the inventive compositions will find utility as oil-wetting additives in other methods besides refinery desalting, retaining asphaltenes in an oil phase, and retaining solid corrosive components in a hydrocarbon phase.

The present invention may suitably comprise, consist of or consist essentially of the elements disclosed and may be practiced in the absence of an element not disclosed. For instance, the method of retaining solid contaminants in a hydrocarbon phase comprising, consisting essentially of, or consisting of, adding to a mixture of the hydrocarbon phase and an aqueous phase, where the mixture comprises, consists essentially of, or consists of, solid contaminants, an additive composition comprising an effective amount of an oil-wetting additive to retain at least a portion of the solid contaminants in the hydrocarbon phase as contrasted with an aqueous phase, where the oil-wetting additive comprises, consists essentially of, or consists of a surface-active additive selected from the group consisting of drilling fluid additives, surfactants, antifoulants, and combinations thereof.

Further, there may be provided a treated mixture comprising, consisting essentially of, or consisting of, a hydrocarbon phase, an aqueous phase, solid contaminants, and an additive composition comprising, consisting essentially of, or consisting of an effective amount of an oil-wetting additive to retain solid contaminants in the hydrocarbon phase as contrasted with an aqueous phase, where the oil-wetting additive comprises, consists essentially of, or consists of a surface-active additive selected from the group consisting of drilling fluid additives, surfactants, antifoulants, and combinations thereof.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, the term "and/or" includes any and all combinations of one or more of the associated listed items.

As used herein, relational terms, such as "first," "second," "top," "bottom," "upper," "lower," "over," "under," etc., are used for clarity and convenience in understanding the disclosure and do not connote or depend on any specific preference, orientation, or order, except where the context clearly indicates otherwise.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

What is claimed is:

1. A method of retaining solid contaminants in a hydrocarbon phase comprising:

adding to a mixture of the hydrocarbon phase and an aqueous phase, where the mixture comprises solid contaminants, an additive composition comprising an effective amount of an oil-wetting additive to retain at least a portion of the solid contaminants in the hydrocarbon phase as contrasted with the aqueous phase, where the oil-wetting additive comprises a surface-active additive selected from the group consisting of drilling fluid additives, surfactants, antifoulants, and combinations thereof, wherein the additive composition further comprises a demulsifier comprising a nonylphenol resin oxyalkylate blended with an aromatic solvent and an oxyalkylated alkyl phenol resin selected from the group consisting of p-t-amylphenol resin oxyalkylate and p-t-butylphenol resin oxyalkylate.

2. The method of claim 1 where at least 95 wt % of the solid contaminants are retained in the hydrocarbon phase.

3. The method of claim 1 where the effective amount of the oil-wetting additive ranges from about 5 ppm to about 500 ppm, based on the mixture.

4. The method of claim 1 where the oil-wetting additive comprises a surface-active additive selected from the group consisting of:

a drilling fluid additive selected from the group consisting of alkyl sulfonate surfactants and blends of an alkyl sulfonate surfactant, propylene glycol, and an alcohol;

a surfactant selected from the group consisting of surfactants having a hydrophobic-lipophilic balance between about 3 and about 6; and an antifoulant selected from the group consisting of polyalkylsuccinimides, mixtures of the reaction product of an olefin with an anhydride and a peroxide and a polyolefin amide alkeneamine, a reaction product of a polyolefin phenol with an amine, a fatty acid, and formaldehyde; and combinations thereof.

5. The method of claim 1 where the solid contaminant is selected from the group consisting of metals, salts, and combinations thereof.

6. The method of claim 1 where the method is a refinery desalting process for crude oil and the method further comprises:

adding to a crude oil containing solid contaminants an effective amount of the oil-wetting additive to retain solid contaminants in the hydrocarbon phase as contrasted with the aqueous phase;

mixing wash water with the crude oil to create an emulsion; and resolving the emulsion into the hydrocarbon phase and the aqueous phase in a refinery desalting process using electrostatic coalescence, where at least a portion of the solid contaminants are retained in the hydrocarbon phase.

7. The method of claim 1 where the solid contaminants comprise asphaltenes.

8. The method of claim 1 where the mixture of the hydrocarbon phase and the aqueous phase is an oilfield stream and the solid contaminant comprises a solid corrosive component selected from the group consisting of inorganic acids, organic acids, salts, and combinations thereof.

9. A treated mixture comprising:

a hydrocarbon phase;

an aqueous phase;

solid contaminants; and an additive composition comprising an effective amount of an oil-wetting additive to retain solid contaminants in the hydrocarbon phase as contrasted with the aqueous phase, where the oil-wetting additive comprises a surface-active additive selected from the group consisting of drilling fluid additives, surfactants, antifoulants, and combinations thereof, and a demulsifier comprising a nonylphenol resin oxyalkylate blended with an aromatic solvent and an oxyalkylated alkyl phenol resin selected from the group consisting of p-t-amylphenol resin oxyalkylate and p-t-butylphenol resin oxyalkylate.

10. The treated mixture of claim 9 where at least 95 wt % of the solid contaminants are retained in the hydrocarbon phase.

11. The treated mixture of claim 9 where the effective amount of the oil-wetting additive ranges from about 5 ppm to about 500 ppm, based on the treated mixture.

12. The treated mixture of claim 9 where the oil-wetting additive comprises a surface-active additive selected from the group consisting of:

a drilling fluid additive selected from the group consisting of alkyl sulfonate surfactants and blends of an alkyl sulfonate surfactant, propylene glycol, and an alcohol;

a surfactant selected from the group consisting of surfactants having a hydrophobic-lipophilic balance between about 3 and about 6; and an antifoulant selected from the group consisting of polyalkylsuccinimides, mixtures of the reaction product of an olefin with an anhydride and a peroxide and a polyolefin amide alkeneamine, a reaction product of a polyolefin phenol with an amine, a fatty acid, and formaldehyde; and combinations thereof.

13. The treated mixture of claim 9 where the solid contaminant is selected from the group consisting of metals, salts, and combinations thereof.

14. The treated mixture of claim 9 where the hydrocarbon phase further comprises crude oil.

15. The treated mixture of claim 9 where the solid contaminants comprise asphaltenes.

16. The treated mixture of claim 9 where the mixture of the hydrocarbon phase and the aqueous phase is an oilfield stream and the solid contaminant comprises a corrosive component selected from the group consisting of inorganic acids, organic acids, salts, and combinations thereof.

* * * * *